US007204954B2

(12) United States Patent
Mizuno et al.

(10) Patent No.: US 7,204,954 B2
(45) Date of Patent: Apr. 17, 2007

(54) CONTAINER

(75) Inventors: Hitoshi Mizuno, Toyota (JP); Tsuyoshi Abe, Toyota (JP)

(73) Assignee: Hoei Shokai Co., Ltd., Aichi (JP)

( * ) Notice: Subject to any disclaimer, the term of this patent is extended or adjusted under 35 U.S.C. 154(b) by 85 days.

(21) Appl. No.: 10/451,842

(22) PCT Filed: Dec. 27, 2001

(86) PCT No.: PCT/JP01/11534

§ 371 (c)(1),
(2), (4) Date: Jun. 26, 2003

(87) PCT Pub. No.: WO02/051740

PCT Pub. Date: Jul. 4, 2002

(65) Prior Publication Data

US 2004/0070122 A1 Apr. 15, 2004

(30) Foreign Application Priority Data

Dec. 27, 2000 (JP) ..... 2000-399465

(51) Int. Cl.
*C21C 5/42* (2006.01)
*C21B 7/12* (2006.01)

(52) U.S. Cl. ..... 266/239; 266/275; 222/595

(58) Field of Classification Search ..... 266/45, 266/236, 239, 275; 222/595
See application file for complete search history.

(56) References Cited

U.S. PATENT DOCUMENTS 3,810,564 A * 5/1974 Allyn et al. ..... 266/239
5,271,539 A * 12/1993 Ozawa et al. ..... 222/595
5,708,257 A 1/1998 Comarteau et al.
5,916,471 A 6/1999 Hall

FOREIGN PATENT DOCUMENTS

| | | | |
|---|---|---|---|
| EP | 0252318 | A1 | 1/1988 |
| EP | 1304184 | A1 | 4/2003 |
| GB | 1291537 | A1 | 10/1972 |
| JP | 02-052164 | A1 | 2/1990 |
| JP | 04-127952 | A1 | 4/1992 |
| JP | 08-020826 | A1 | 1/1996 |
| JP | 08-164471 | A1 | 6/1996 |
| JP | 2001-138033 | A1 | 5/2001 |

OTHER PUBLICATIONS

Internation Preliminary Examination Report (English Translation), Dec. 27, 2001.
Examination Report dated Nov. 28, 2003 issued by the UK Patent Office.

* cited by examiner

*Primary Examiner*—Scott Kastler
(74) *Attorney, Agent, or Firm*—Rader, FIshman & Grauer PLLC

(57) ABSTRACT

A container does not need a member such as a stoke and the like that are exposed to the molten metal therein, thus the necessity to replace the parts such as the stoke and the like can be eliminated. In addition, there is no structure like the stoke in the container, the operability for the preheating is improved thus the preheating can be performed effectively. In addition, since a flow passage is formed inside the lining with high heat conductivity, inner heat of the container is easily conducted to the flow passage. Thus, the decrease in temperature of the molten metal that flows inside the flow passage can be suppressed to the utmost.

14 Claims, 9 Drawing Sheets

CONTAINER

TECHNICAL FIELD

The present invention relates to a container used to transport, for example, molten aluminum.

BACKGROUND ART

In a factory where aluminum is molded using many die-casting machines, an aluminum material is often supplied not only from within the factory but also from outside the factory. In this case, a container storing aluminum in a melt is carried from a factory on the material supply side to a factory on the molding side to supply to each of the die-casting machines the material kept in the melt.

DISCLOSURE OF THE INVENTION

The present inventors propose a technique of supplying the molding material from such a container to the die-casting machine side utilizing a pressure difference. More specifically, this technique applies a pressure to the container to pour a molten material in the container to the outside through a pipe led to the container. As such a container, it is possible to use, for example, an apparatus disclosed in Japanese Patent Laid-Open No. Hei 8-20826.

The apparatus disclosed in Japanese Patent Laid-Open No. Hei 8-20826, however, has a problem that since its stoke is kept exposed to the molten metal in the container, there often occurs a necessity to replace the oxidized and corroded stoke.

Besides, when such a container is carried between factories, the inside of the container is first preheated using a gas burner or the like, and then the molten material is supplied into the container. The apparatus disclosed in Japanese Patent Laid-Open No. Hei 8-20826 has another problem that the stoke needs to be removed together with a large lid for holding a stoke for preheating, because the stoke in the container is an obstacle during the preheating, leading to a very low productivity.

The present invention is made to solve the above-described problems, and its object is to provide a technique of requiring no replacement of parts such as stoke and the like.

It is another object of the present invention to provide a technique capable of efficiently performing preheating.

A further object of the present invention is to provide a container capable of suppressing the decrease in temperature of the molten metal when loading and supplying thereof as much as possible.

To solve such a problem, a major aspect of the present invention is a container for storing a molten metal, comprising a frame; and a lining, disposed inside the frame, having a passage capable of flowing the molten metal therein. The lining is an inner layer coated on the frame, having a holding function of molten metal and a heat insulating function. In addition, the present invention is a container for storing a molten metal, comprising a frame; a first lining disposed inside the frame, having a passage capable of flowing the molten metal therein, the first lining having a first heat conductivity; and a second lining disposed between the frame and the first lining, the second lining having a second heat conductivity lower than the first heat conductivity.

According to the present invention, for example, a refractory member is used as the first lining and a heat insulation member is used as the second lining. The density and heat conductivity of the refractory member are relatively higher than those of the heat insulation member. In other words, as the refractory member, a material that has strength against molten aluminum is used. As an example of such a refractory member, there is a dense fire resistant ceramic material. In addition, the density and heat conductivity of the heat insulation member are lower than those of the refractory member. As examples of the heat insulation member, there are heat insulation ceramic materials such as a heat insulation caster and a board material.

In the present invention, compared to the apparatus disclosed in Japanese Patent Laid-Open No. Hei 8-20826, members such as a stoke and the like that are exposed to the molten metal in the container become unnecessary, thus eliminating the necessity to replace the parts such as the stoke and the like. In addition, when the container is preheated, stoke is often oxidized due to excessive heat. As a result, stoke is sometimes pitted or damaged. In contrast, according to the present invention, since the container has no stokes and is provided with a passage in a lining instead, there is no risk of such damage. In addition, in the present invention, no member such as stoke which obstructs preheating is disposed in the container to improve the productivity for preheating, thus enabling efficient preheating. In addition, after the molten metal is loaded to the container, an operation for scooping oxide and the like out from the surface of the molten metal is sometimes required. With stoke in the container, the operation is obstructed. However, according to the present invention, since there is no structure such as a stoke in the container, the operability thereof is improved. In addition, according to the present invention, since a flow passage is formed inside the first lining, which has high heat conductivity, heat inside the container is easily conducted to the flow passage. Thus, the decrease in temperature of the molten metal that flows inside the flow passage can be suppressed to the utmost.

According to the present invention, it is preferable that the flow passage is formed in a first lining from a position close to a bottom portion of the container to an exposed portion of the first lining on an upper surface side of the container and a pipe is to be connected to the passage of the exposed portion of the first lining, however, it is preferable that a heat insulation member surrounds a connecting portion between the passage and the pipe. With this configuration, the decrease in temperature of the molten metal that flows inside the flow passage and the pipe can be suppressed further. Especially, the molten metal tends to be cooled in the vicinity of the connecting portion of the pipe. In addition, when the container is transported, liquid surface of the molten metal sways near the connecting portion and, as a result, the molten metal used to solidify often. In contrast, according to the present invention, as the vicinity of the connecting portion of the pipe is surrounded by a heat insulation member, the molten metal can be prevented from being solidified at that portion.

It is preferable that the passage has an effective inner diameter, and the effective inner diameter is larger than approximately 50 mm and smaller than approximately 100 mm, more preferably in the range from approximately 65 mm to approximately 85 mm, further preferably in the range from approximately 70 mm to approximately 80 mm, most preferably 70 mm. The values are obtained by the inventors from the result of a study on the relationship between diameter of flow passage and required pressure.

In addition, it is preferable that the container further comprises a hatch, disposed on an upper surface portion of the container, capable of being opened and closed, and having a through hole connecting an inside and an outside of the container, and the through hole capable of adjusting an inner pressure of the container. Further, it is preferable that the hatch is disposed close to a center of the upper surface portion of the container.

According to the present invention, having a hatch of this kind enables a gas burner to be inserted into the container there through before the molten metal is loaded to the container so that the inside of the container can be preheated. As a result of the preheating, the flow passage as a route of the thermal transfer of a refractory member can be preheated. Thus, the flow passage can be more effectively prevented from getting clogged than before. When the temperature of the flow passage is kept high, the viscosity of the molten metal becomes low. Thus, the molten metal can be loaded to and discharged from the container with a smaller pressure difference than before. Since the flow passage can be preheated in such a manner when the molten metal is loaded to the container through the flow passage, in the present invention, the molten metal can be supplied effectively.

As described above, before the molten metal is loaded to the container, the inside thereof is preheated with a gas burner. The preheating operation is performed as opening the hatch and inserting the gas burner into the container. Thus, every time the molten metal is loaded to the container, the hatch is opened. According to the present invention, since the hatch has an inner pressure adjusting through-hole, therefore, whether or not the metal is attached to the inner pressure adjusting through-hole can be checked every time the molten metal is loaded to the container. Then the metal can be peeled off each time the metal is found attached to the through-hole. Thus, according to the present invention, the clogging of the pipe and opening can be prevented in advance.

Another aspect of the present invention is a container, comprising a sealed type main body capable of storing a molten metal and a passage capable of flowing the molten metal therein, the passage extending upward to an outer periphery of the main body through an opening formed at a position close to a bottom portion of the main body on an inner periphery of the main body, and adjusting means adjusting the pressure inside the container.

Another aspect of the present invention is a container, comprising a storing room for storing a molten metal an interface portion as a passage for the molten metal between the storing room and an outside of the container, and a partition wall made of, for example, a refractory member, having a passage capable of flowing the molten metal therein disposed between the storing room and the interface portion, for separating the storing room and the interface portion.

Yet another aspect of the present invention is a container, comprising a sealed type main body capable of storing a molten metal, the main body having a through hole for adjusting an inner pressure of the container and a fire resistant wall having a passage capable of flowing the molten metal therein, surrounding an inner wall of the main body, the passage extending upward through an opening formed at a position close to a bottom portion of the main body on an inner periphery of the main body.

According to the present invention, since the flow passage for the molten metal is formed with a fire resistant wall that has high heat conductivity that surrounds the inner wall of the main body of the container, when the molten metal is loaded to the container, heat from the molten metal is conducted to the fire resistant wall, therefore, the temperature of the flow passage becomes almost equal to that of the molten metal. Likewise, when inside of the container is preheated, the flow passage is heated effectively through the fire resistant wall being the route for the thermal conduction. Thus, when the molten metal that flows inside the flow passage is not cooled therewith, the molten metal does not solidify at the front surface of the flow passage, nor does the molten metal attaches thereto. In other words, when the molten metal solidifies and attaches to the flow passage, the passage tends to get clogged (as in a conventional pipe). In contrast, according to the present invention, the flow passage can be prevented effectively from getting clogged. In addition, according to the present invention, since the temperature of the flow passage becomes almost equal to the temperature of the molten metal, the viscosity of the molten metal that flows near the front surface of the flow passage does not decrease, enabling the molten metal to be supplied from the container or loaded into the container with a smaller pressure difference than before. In other words, in the container according to the present invention, the flow passage for the molten metal is made of a fire resistant wall that has a high heat conductivity and that surrounds the inner wall of the container so that the temperature of the flow passage becomes almost equal to the temperature of the molten metal stored in the container. Thus, the present invention is very effective for a system that loads the molten metal to a container and loads the molten metal therefrom using a pressure difference.

Since the container according to the present invention has a through-hole for adjusting an inner pressure, when the inside of the container is applied with a negative pressure through the through-hole, the molten metal can be loaded to the container through the flow passage. According to the present invention, since the hot molten metal is loaded to the container through the flow passage in the foregoing manner, the molten metal cleans the metal that is attached to the front surface of the flow passage. Thus, due to the through-hole for adjusting an inner pressure provided in the present invention, the clogging can be prevented effectively.

The container according to one form of the present invention further comprises a heat insulation member disposed between the inner wall of the main body of the container and the fire resistant wall. Since the whole container should have high degree of heat insulation, an insulation member of high heat insulation is lined. In addition, a portion that directly contacts the molten metal is lined with a refractory member. In the container according to the present invention, a fire resistant caster material is disposed in a zone that separates the inside of the container from the flow passage. The heat conductivity of the area is intentionally and relatively designed larger than that of the other area. The density and the heat conductivity of the refractory member are designed so that they are larger than those of the heat insulation member. As an example of the refractory member, there is a dense fire resistant caster. As examples of the heat insulation member, there are a heat insulation caster and board materials. Since the container is structured in such a manner, In addition that the molten metal stored in the container is heat-insulated, heat can easily be conducted to the foregoing flow passage. Thus, the flow passage can be sufficiently prevented from being cooled from the outside. As a result, the flow passage can be more effectively prevented from getting clogged than before. In addition, since the viscosity of the molten metal can be kept low, the molten metal can be loaded to and supplied from the container with a small pressure difference.

In the container according to an embodiment of the present invention, the bottom portion of the main body of the container is tilted toward the opening so that the opening is at a low position. With this configuration, when the amount of the molten metal in the container becomes small, the area in which the refractory member in the vicinity of the flow passage contacts the molten metal in the container becomes substantially larger than the area in which the refractory member apart from the flow passage contacts the molten metal in the container. Thus, the flow passage can be prevented from being cooled to the utmost. Consequently, the flow passage can be more effectively prevented from getting clogged than before. In addition, the molten metal can be loaded to and supplied from the container with a smaller pressure difference than before. Furthermore, when the amount of the molten metal becomes small, it can be supplied effectively from the container by tilting the container at a small tilting angle while the flow passage is prevented from getting clogged to the utmost.

BEST MODES FOR CARRYING OUT THE INVENTION

Hereinafter, embodiments of the present invention will be described with reference to the drawings.

Figure 1:
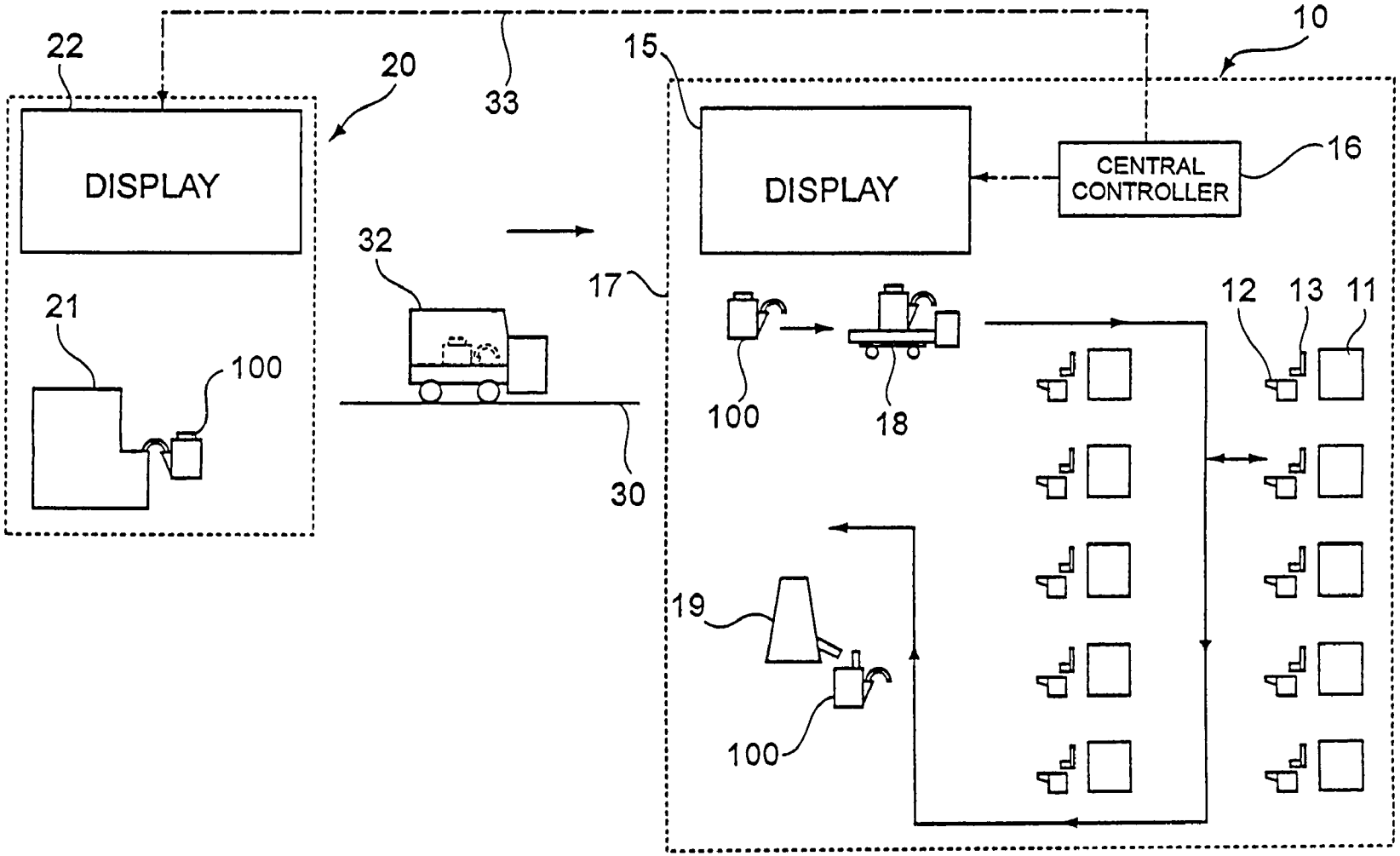
FIG. 1 is a schematic diagram showing the structure of a metal supplying system according to an embodiment of the present invention.

FIG. 1 is a schematic diagram showing the entire configuration of a metal supply system according to an embodiment of the present invention.

As shown in the drawing, a first factory 10 and a second factory 20 are provided at locations apart from each other across, for example, a public road 30.

In the first factory 10, a plurality of die-casting machines 11 are arranged as use points. Each of the die-casting machines 11 molds products in a desired shape by injection molding using molten aluminum as a raw material. The products can include, for example, parts relating to an engine of an automobile and the like. Besides, the molten metal is not limited only to an aluminum alloy, but alloys containing other metals such as magnesium, titanium, and so on as main constituents are also usable. Near the die-casting machines 11, there are storing furnaces (local storing furnaces) 12 that temporarily store molten aluminum before shots. This local storing furnace 12 is designed to store the molten aluminum for a plurality of shots, so that the molten aluminum is injected from the storing furnace 12 into the die-casting machine 11 through a tandish (container) 13 or a pipe for every shot. Further, each of the storing furnaces 12 is provided with a level sensor (not shown) that detects the level of the molten aluminum stored in a container and a temperature sensor (not shown) that detects the temperature of the molten aluminum. Detection results by these sensors are passed to a control panel of each of the die-casting machines 11 or a central controller 16 in the first factory 10.

At a receiving station of the first factory 10, a receiving table 17 is disposed for receiving a later-described container 100. The container 100 received at the receiving table 17 in the receiving station is delivered by a delivery vehicle 18 to a predetermined die-casting machine 11, so that the molten aluminum is supplied from the container 100 to the storing furnace 12. The container 100 after completion of the supply is returned to the receiving table 17 in the receiving station again by the delivery vehicle 18.

In the first factory 10, a first furnace 19 is provided for melting aluminum and supplying it to the container 100, and the container 100 supplied with the molten aluminum from the first furnace 19 is also delivered by the delivery vehicle 18 to a predetermined die-casting machine 11.

In the first factory 10, a display 15 is disposed which states a fact that the die-casting machines 11 demand for the additional aluminum melt. More specifically, for example, an ID number is given to every die-casting machine 11 and displayed on the display 15, so that the number on the display 15 corresponding to the die-casting machine 11 which demands for the additional molten aluminum is lighted up. Based on the display on the display 15, an operator carries the container 100 to the die-casting machine 11 corresponding the number using the delivery vehicle 18 to supply the molten aluminum. The display on the display 15 is performed by a control of the central controller 16 based on the detection result by the level sensor of the aluminum melt.

In the second factory 20, a second furnace 21 is provided for melting aluminum and supplying it to the container 100. A plurality of types of containers 100 are provided which are different, for example, in capacity, pipe length, height, width, and so on. For example, there are a plurality of types of containers 100 different in capacity in accordance with the capacities or the like of the local storing furnaces 12 for the die-casting machines 11 in the first factory 10. However, it is, of course, adoptable to unify the containers 100 into one standard.

The containers 100 supplied with the molten aluminum from the second furnace 21 are mounted on a truck 32 for carriage by means of a fork lift truck (not shown). The truck 32 carries the containers 100 through the public road 30 to near the receiving table 17 in the receiving station in the first factory 10, so that the containers 100 are received at the receiving table 17 by means of a fork lift truck (not shown). Besides, vacant containers 100 placed in the receiving station are returned to the second factory 20 by the truck 32.

In the second factory 20, a display 22 is disposed which states a fact that the die-casting machines 11 in the first factory 10 call additional molten aluminum. The display 22 is almost the same in configuration as the display 15 in the first factory 10. The display on the display 22 is performed by a control of the central controller 16 in the first factory 10, for example, via a communication line 33. It should be noted that, out of the die-casting machines 11 which demand for supply of the molten aluminum, the die-casting machines 11, which are determined to be supplied with the molten aluminum from the first furnace 19 in the first factory 10, are displayed in distinction from the other die-casting machines 11 on the display 22 in the second factory 20. For example, it is designed to blink the numbers corresponding to the die-casting machines 11 determined as above. This can prevent the molten aluminum from being supplied by mistake from the second factory 20 side to the die-casting machines 11 which have been determined to be supplied with the molten aluminum from the first furnace 19. Further, on this display 22, data transmitted from the central controller 16 is also displayed in addition to the above display.

Next, description will be made on the action of the metal supply system configured as described above.

The central controller 16 monitors the amount of the molten aluminum in each of the storing furnaces 12 through the level sensor provided at each of the local storing furnaces 12. When there arises a demand for supplying the molten aluminum to one storing furnace 12, the central controller 16 transmits to the second factory 20 side through the communication line 33 the "ID number" of the storing furnace 12, "temperature data" of the storing furnace 12 detected by the temperature sensor provided at the storing furnace 12, "form data" on the form (described later) of the storing furnace 12, final "time data" of the storing furnace 12 running out of the molten aluminum, "traffic data" of the public road 30, "amount data" of the molten aluminum required for the storing furnace 12, "temperature data", and so on. In the second factory 20, these data are displayed on the display 22. Based on these displayed data, the operator determines on his or her experiences the point of time for dispatch of the container 100 from the second factory 20 and the temperature of the molten aluminum at the time of the dispatch so that the container 100 is delivered immediately to the storing furnace 12 before the storing furnace 12 runs out of the molten aluminum and the molten aluminum at that time is at a desired temperature. Alternatively, it is also adoptable to capture these date into a personal computer (not shown), estimate, through use of predetermined software, the point of time for dispatch of the container 100 from the second factory 20 and the temperature of the molten aluminum at the time of the dispatch so that the container 100 is delivered immediately to the storing furnace 12 before the storing furnace 12 runs out of the molten aluminum and the molten aluminum at that time is at a desired temperature, and display the time and temperature. Alternatively, it is also adoptable to automatically control the temperature of the second furnace 21 based on the estimated temperature. It is also adoptable to determine the amount of the molten aluminum to be stored in the container 100 based on the aforementioned "amount data."

When the truck 32 with the container 100 mounted thereon departs, passes the public road 30, and arrives at the first factory 10, the container 100 is received from the truck 32 at the receiving table 17 in the receiving station.

Then, the received container 100 is delivered together with the receiving table 17 to a predetermined die-casting machine 11 by the delivery vehicle 18 so that the molten aluminum is supplied from the container 100 to the storing furnace 12.

Figure 2:
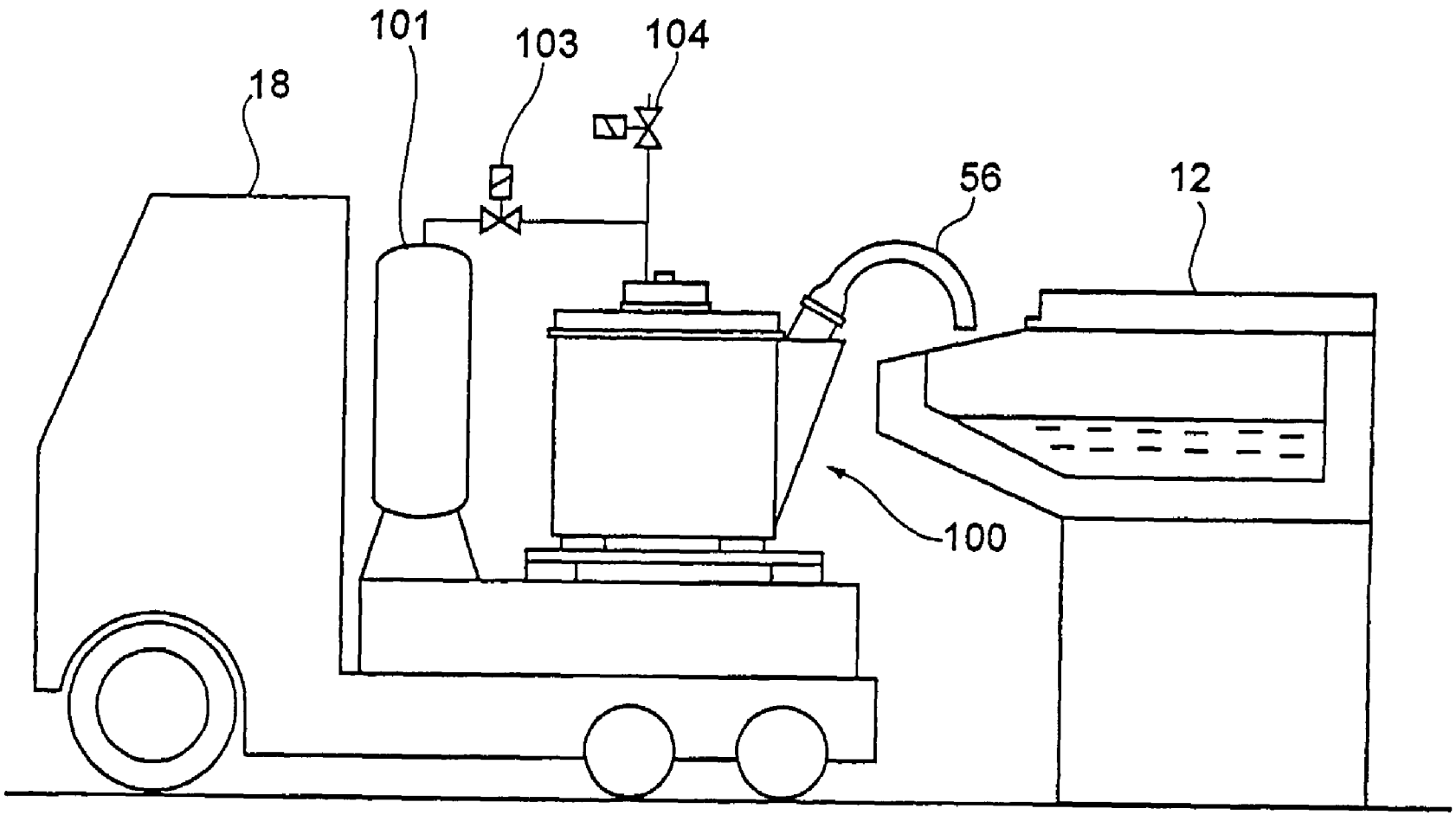
FIG. 2 is a schematic diagram showing the relation between a container and a storing furnace according to the embodiment of the present invention.

As shown in FIG. 2, this example is configured such that compressed air is sent out from a reservoir tank 101 into the hermetic type container 100 to cause the molten aluminum stored in the container 100 to be discharged through a pipe 56 and supplied to the storing furnace 12. Note that numeral 103 denotes a pressure valve, and numeral 104 denotes a leak valve in FIG. 2.

By the way, the storing furnaces 12 have various heights, and the tip of the pipe 56 is controllable to be placed at an optimal position above the storing furnace 12 by means of a lifting mechanism provided on the delivery vehicle 18. The lifting mechanism, however, cannot cope by itself with the storing furnace 12 depending on its height in some cases. Hence, in this system, data regarding the height of the storing furnace 12, the distance to the storing furnace 12, and so on are previously sent to the second factory 20 side as the "form data" regarding the form of the storing furnace 12, and on the second factory 20 side, for example, the container 100 having an optimal form, for example, an optimal height is selected and delivered based on the data. Note that the container 100 having an optimal size may be selected and delivered in accordance with the amount to be supplied.

Figure 3:
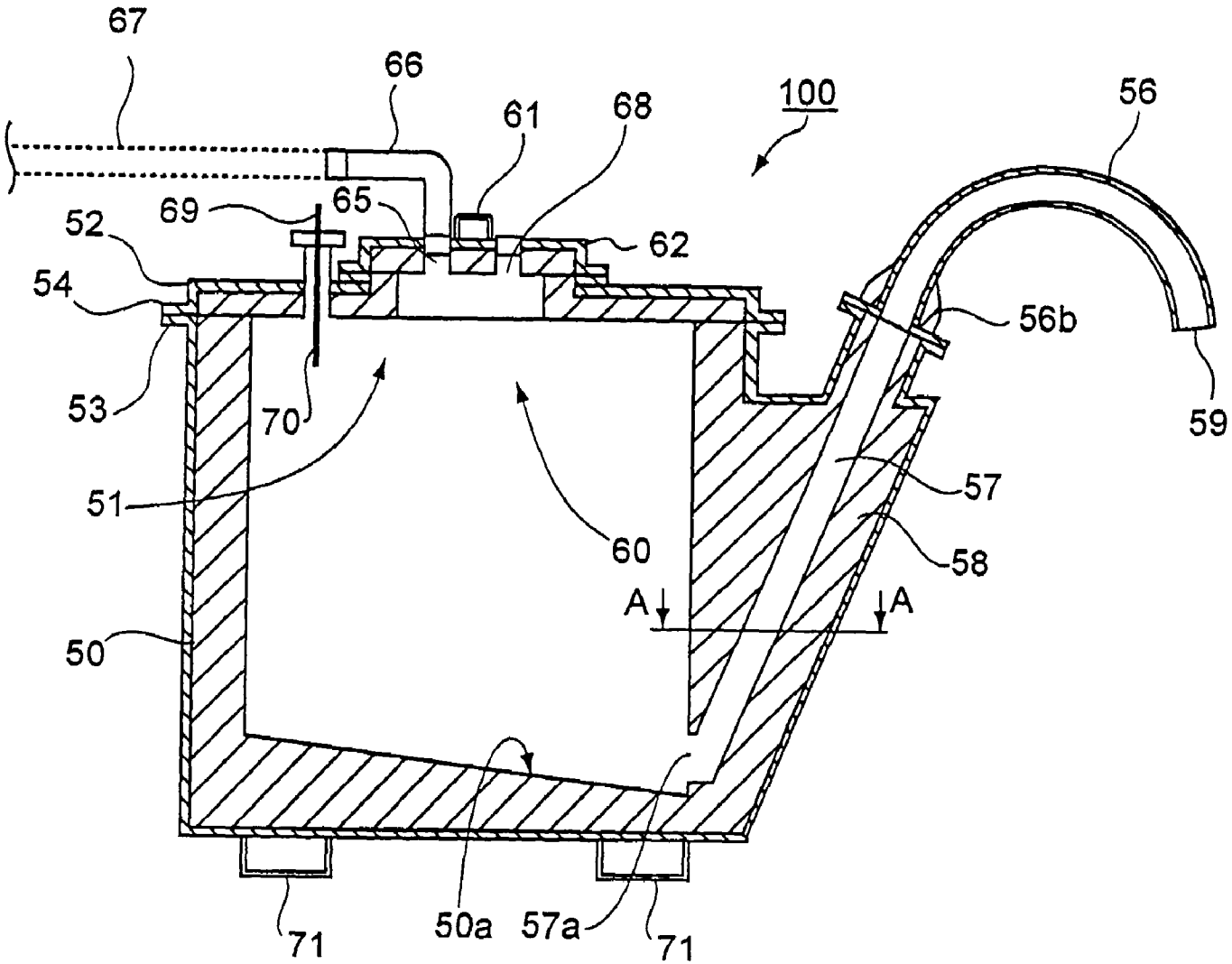
FIG. 3 is a cross-sectional view showing the container according to the embodiment of the present invention.
Figure 4:
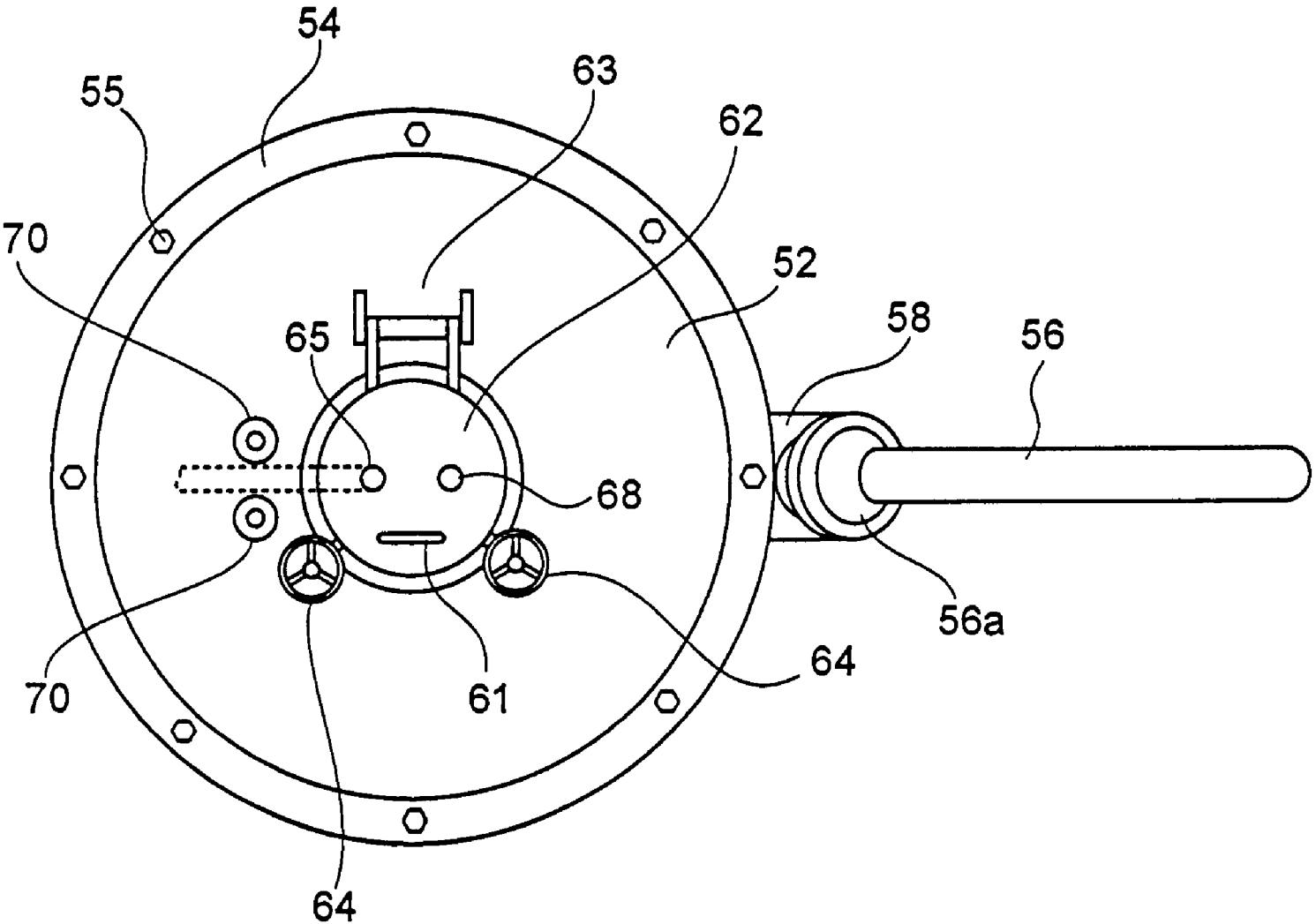
FIG. 4 is a plane view of FIG. 3.

Next, the container 100 (container capable of supplying the molten metal by pressure) suitable for the system configured as described above will be described with reference to FIG. 3 and FIG. 4. FIG. 3 is a cross-sectional view of the container 100, and FIG. 4 is a plane view thereof.

The container 100 is configured such that a large lid 52 is provided at an upper opening 51 of a bottomed cylindrical body 50. Flanges 53 and 54 are provided at outer peripheries of the body 50 and the large lid 51 respectively, so that the flanges are fastened together with bolts 55 to fix the large lid 51 to the body 50. It should be noted that the outside of the body 50 and the large lid 51 is made of, for example, metal and the inside thereof is made of refractories, with a heat insulator being inserted between the metal frame and the refractories.

At one point on the outer periphery of the body 50, a pipe attachment portion 58 is provided which is provided with a flow passage 57 starting from the inside of the body 50 and communicating with the pipe 56.

Figure 5:
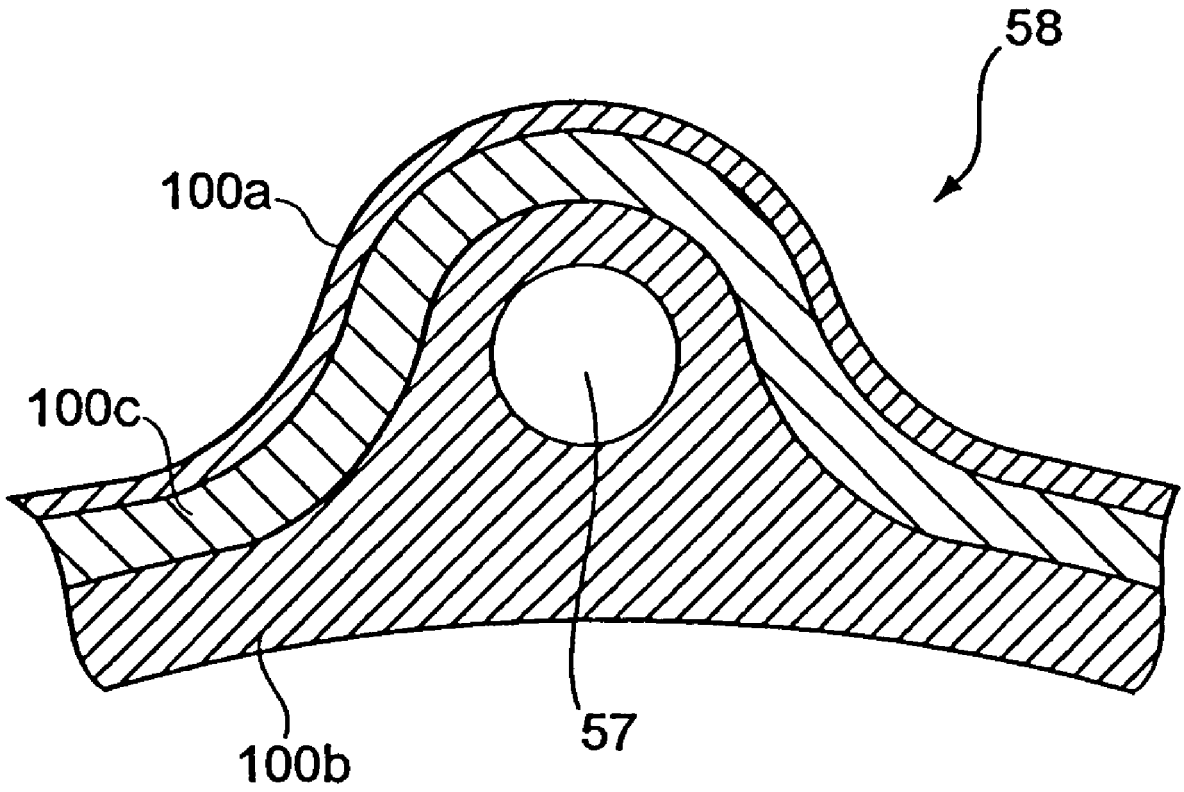
FIG. 5 is a cross sectional view of FIG. 3.

Here, FIG. 5 is a cross-sectional view taken along a line A—A across the pipe attachment portion 58 shown in FIG. 3.

As shown in FIG. 5, the outside of the container 100 is constituted of a metal frame 100*a*, and the inside thereof is constituted of a refractory member 100*b* (first lining), and a heat insulation 100*c*, having a heat conductivity smaller than that of the refratories (second lining), being inserted between the frame 100*a* and the refractory member 100*b*. The flow passage 57 is formed in the refractory member 100*b* disposed inside the container 100. In other words, the flow passage 57 is formed in the refractory member 100*b* and extends from a position close to the bottom of the container 100 to an exposed portion of the refractory member 100*b* on the upper surface of the container 100. Thus, the flow passage 57 is separated from the inside of the container by the refractory member having a large heat conductivity. With such a structure, heat is easily conducted from the inside of the container to the flow passage. Disposed outside the flow passage (opposite side of the inside of the container) is a heat insulation member that is outside the refractory member. As the refractory member, a material having a higher density and a higher heat conductivity than the heat insulation member is used. As an example of the refractory member, a dense fire resistant ceramic material may be used. As examples of the heat insulation member, heat insulation ceramic materials such as a heat insulation caster and a board material can be used.

The flow passage 57 in the pipe attachment portion 58 extends toward an upper portion 57*b* on the outer periphery of the body 50, through an opening 57*a* provided at a position on the inner periphery of the body 50 close to a bottom portion 50*a* of the container body. The pipe 56 is fixed to communicate with the flow passage 57 in the pipe attachment portion 58. The pipe 56 has an inverse U-letter shape (having a curvature) and the flow passage in the pipe 56 has an inverse U-letter shape corresponding to the curvature of the pipe 56. Thus, end portion 59 of the pipe 56 faces downward. Since the pipe 56 has such a shape, molten aluminum smoothly flows in the pipe 56. In other words, when the inside of the pipe has a discontinuous surface, the molten metal collides with the portion and corrodes the portion ultimately causing a problem like a hole being made in the pipe. In contrast, when the flow passage of the pipe has a curvature, since there is no discontinuous surface, such a problem does not occur.

A heat insulation member 56*a* is disposed approximately the pipe 56 in the vicinity of the pipe attachment portion 58. Thus, the heat insulation member 56*a* prevents the pipe 56 from absorbing heat of the flow passage 57. Thus, the decrease in temperature of the flow passage 57 can be suppressed to the utmost. In particular, the pipe 56 disposed in the vicinity of the pipe attachment portion 58, molten metal tends to be cooled. In addition, when the container is transported, in the vicinity of the pipe 56, the liquid surface of molten metal sways. Thus, since the periphery of the pipe 56 in the vicinity of the pipe attachment portion 58 is surrounded by the heat insulation member 56*a*, molten metal can be prevented from being solidified at that position.

The inner diameter of the flow passage 57 is almost equal to that of the pipe 56 directly connected thereto. The inner diameters of the flow passage 57 and the pipe 56 are preferably in the range from approximately 65 mm to 85 mm. Conventionally, the inner diameters of those types of pipes are approximately 50 mm. This is because it was thought that when the inner diameters of those pipes exceed 50 mm, a large pressure is required to apply pressure to the inside of the container and discharge molten metal from them. However, the inventors of the present invention found that the inner diameters of the flow passage 57 and the pipe 56 directly connected thereto are preferably in the range from approximately 65 mm to 85 mm, which is much larger than 50 mm and that they are more preferably in the range from approximately 70 mm to 80 mm, and that they are further more preferably 70 mm. In other words, it is thought that when molten metal flows upward in the flow passage and the pipe, two parameters, the weight of the molten metal itself in the flow passage and the pipe and the viscous drag of the inner walls of the flow passage and the pipe largely affect the resistance that obstructs the flow of the molten metal. When the inner diameters are smaller than 65 mm, molten metal that flow in the flow passage is affected by the weight of the molten metal and the viscous drag of the inner walls at any positions. However, when the inner diameters exceed 65 mm, an area that is not affected by the viscous drag of the inner walls starts to form nearly at the center of the flow and becomes larger and larger. The area has a large influence and, as a result, the resistance that obstructs the flow of the molten metal starts to fall. Thus, it becomes that only a very small pressure is needed to discharge the molten metal from the container. In other words, conventionally, the influence of such an area was not considered at all, and only the weight of the molten metal is considered as a cause of varying resistance that obstructs the flow of the molten metal. Due to the operability, maintenability, and so forth, the inner diameters was designated approximately 50 mm. On the other hand, when the inner diameters exceed 85 mm, the weight of the molten metal becomes dominant as a resistance that obstructs the flow of the molten metal. As a result, the resistance that obstructs the flow of the molten metal becomes large. A prototype that the inventors of the present invention manufactured shows that when the inner diameters of the flow passage and the pipe are in the range from approximately 70 mm to approximately 80 mm, and the inside of the container may be applied with a very small pressure. In particular, the inner diameters being 70 mm is the most preferable from the view points of standardization and operability. In other words, the pipe diameters are standardized with an increment of 10 mm such as 50 mm, 60 mm, 70 mm, and so forth. When the pipe diameter is small, the pipe can easily be handled and also the operability is higher.

An opening 60 is formed close to the center of the large lid 52. Disposed at the opening 60 is a hatch 62 that has a handle 61. The hatch 62 is disposed at a slightly higher position than the upper surface of the large lid 52. One position of the outer periphery of the hatch 62 is connected to the large lid 52 through a hinge 63. Thus, the hatch 62 can be opened and closed against the opening 60 of the large lid 52. At two positions of the outer periphery of the hatch 62, bolts 64 with handles are disposed. The bolts 64 secure the hatch 62 to the large lid 52. When the opening 60 of the large lid 52 is closed with the hatch 62 and then the bolts 64 with the handles are turned, the hatch 62 is secured to the large lid 52. Furthermore, when the bolts 64 with the handles are reversely turned, the hatch 62 can be opened from the opening 60 of the large lid 52. While the hatch 62 is open, the inside of the container 100 can be maintained through the opening 60 and a gas burner can be inserted into the container through the opening 60 so as to preheat the inside of the container.

Additionally, an inner pressure adjusting through-hole 65 is provided at the center of the hatch 62 or at a position slightly apart from the center, used for depressurize and pressurize the inside of the container 100. A pipe 66 for applying and reducing the pressure is connected to the through-hole 65. The pipe 66 extends upward from the through-hole 65, bends at a predetermined height, and then extends horizontally. The front surface of the pipe 66 that is inserted into the through-hole 65 is threaded. Likewise, the through-hole 65 is threaded. As a result, the pipe 66 and the through-hole 65 are secured with threads.

The pipe 67 for applying and reducing the pressure can be connected to one end of the pipe 66. A gas tank and a pump for applying the pressure are connected to the pipe for applying the pressure. A pump for reducing the pressure is connected to the pipe for reducing the pressure. With a pressure difference, the pressure inside of the container 100 is reduced, and the molten aluminum can be loaded to the container 100 through the pipe 56 and the flow passage 57. Likewise, with a pressure difference the inside of the container 100 is applied with the pressure, the molten aluminum can be supplied to the outside of the container 100 through the flow passage 57 and the pipe 56. When an inert gas for example nitrogen gas is used as the gas for applying pressure, molten aluminum that is applied with the pressure can be prevented more effectively from being oxidized than before.

According to the present invention, in addition to applying the pressure and reducing the pressure, a through-hole 65 is formed in the hatch 62 s disposed nearly at the center of the large lid 52, since the pipe 66 extends horizontally, the pipe 67 for applying and reducing the pressure can be safely and easily connected to the pipe 66. In addition, since the pipe 66 extends in such a manner, it can be turned against the through-hole 65 with a small force. Thus, the pipe 66 can be connected and disconnected to and from the through-hole 65 with a very small force, for example, without need to use a tool.

A pressure relief through-hole 68 is formed at a position that is slightly apart from the center of the hatch 62 and that is opposite to through-hole 65 for applying and reducing the pressure. A relief valve (not shown) can be mounted to the pressure relief through-hole 68. Thus, when the inner pressure of the container 100 exceeds a predetermined value, from a view point of safety, the inside of the container 100 is released to the atmosphere.

Formed in the large lid 52 are two through-holes 70 at a predetermined interval for disposing two electrodes 69 as a liquid surface sensor therethrough. The electrodes 69 are inserted into the respective through-holes 70. The electrodes 69 are oppositely disposed in the container 100. Tips of the electrodes 69 extend to nearly the same position as the maximum liquid surface of molten metal in the container 100. When the conduction state between the electrodes 69 is monitored, the maximum liquid surface of molten metal in the container 100 can be detected. Thus, the molten metal can be securely prevented from being excessively loaded to the container 100.

On the rear surface of the bottom portion of the main body 50, two leg portions 71 that have a predetermined length are disposed in parallel. The leg portions 71 have openings that fit forks of a forklift (not shown). In addition, the bottom portion of the inside of the main body 50 is inclined toward the flow passage 57. Thus, when the molten aluminum is supplied from the main body 50 to the outside through the flow passage 57 and the pipe 56 with a pressure, the amount of molten aluminum that leaves the inside of the main body 50 becomes small. In addition, when the container 100 is tilted and molten aluminum is supplied to the outside through the flow passage 57 and the pipe 56, since the tilting angle of the container 100 is small, maintenance work for the container 100 can be safely performed with high operability.

Thus, in the container 100 according to the present invention, members such as the stoke and the like which are exposed to the molten metal in the container 100 become unnecessary, thus eliminating the necessity to replace the parts such as the stoke and the like. In addition, in the present invention, no member such as the stoke which obstructs preheating is disposed in the container 100 to improve the productivity for preheating, thus enabling efficient preheating. In addition, after the molten metal is loaded to the container 100, an operation for scooping oxide and the like out from the surface of the molten metal is sometimes required. With stoke in the container, the operation is obstructed. However, according to the present invention, since there is no such a structure such as stoke in the container 100, the operability thereof is improved. In addition, according to the present invention, since a flow passage 57 is formed inside the lining 100*b*, which has high heat conductivity, inner heat of the container is easily conducted to the flow passage 57 (in particular, see FIG. 5). Thus, the decrease in temperature of the molten metal that flows inside the flow passage 57 can be suppressed to the utmost.

In addition, in the container 100, according to the present invention, since the hatch 62 has an inner pressure adjusting through-hole 65 and the inner pressure adjusting pipe 66 is connected to the through hole 65, therefore, whether or not the metal is attached to the inner pressure adjusting through-hole 65 can be checked. Thus the clogging of the pipe 66 and through-hole 65 can be prevented in advance.

Moreover, in the container 100 according to the present invention, since the inner pressure adjusting through-hole 65 is formed in the hatch 62 close to the center of the upper surface portion of the container 100 where the transition of the liquid surface of molten aluminum and the degree of splashing thereof are relatively small. Thus, the possibility of which the molten aluminum attaches to the inner pressure adjusting pipe 66 and through-hole 65 is small. Consequently, the clogging of the inner pressure adjusting pipe 66 and through-hole 65 can be prevented.

In addition, in the container 100 according to the present invention, since the hatch 62 is disposed at the upper surface of the large lid 52, the distance between the rear surface of the hatch 62 and the liquid surface is larger than the distance between the rear surface of the large lid 52 and the liquid surface by the thickness of the large lid 52. Thus, the possibility of which aluminum attaches to the rear surface of the hatch 62 having the through-hole 65 becomes low. As a result, the clogging of the pipe 66 and the through-hole 65 used to adjust inner pressure can be prevented.

Next, with reference to FIG. 6, a supplying system for supplying molten aluminum from the second furnace 21 to a container 100 in the second factory 20 will be described.

Figure 6:
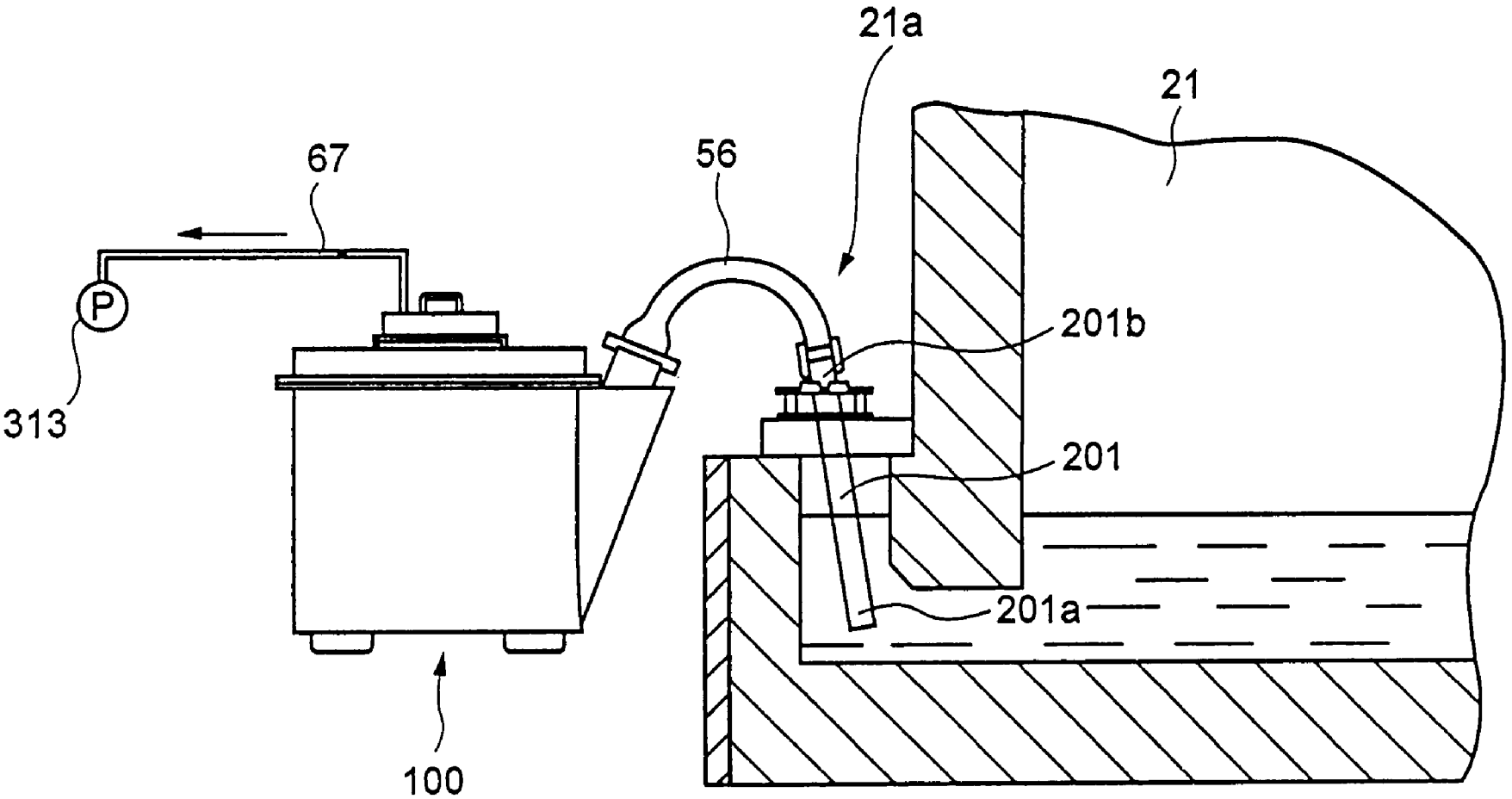
FIG. 6 is a schematic diagram showing the structure of a supplying system for a container in a second factory according to the embodiment of the present invention.

As shown in FIG. 6, molten aluminum is stored in the second furnace 21. The second furnace 21 has a supplying portion 21*a*. A suction pipe 201 is inserted into the supplying portion 21*a*. The suction pipe 201 is disposed so that one tip thereof (a second tip portion 201*b* of the suction pipe 201) appears and immerses from and into the liquid surface of the molten aluminum in the supplying portion 21*a*. In other words, a first tip portion 201*a* of the suction pipe 201 extends near the bottom portion of the second furnace 21. On the other hand, the second tip portion 201*b* of the suction pipe 201 extends outward from the supplying portion 21*a*. The suction pipe 201 is basically held by a holding mechanism 202 with an angle. The suction pipe 201 has a tilting angle of approximately 10° to for example the perpendicular and the tilting angle of the suction pipe 201 accords with the slope of the tip of the pipe 56 of the container 100. The tip portion 201*b* of the suction pipe 201 is connected to the tip portion of the pipe 56. Since their tilting angles match, the tip portion 201*b* of the suction pipe 201 and the tip portion of the pipe 56 of the container 100 can easily be connected.

Thereafter, a pipe 67 is connected to a pump 313 for reducing the pressure is connected to the pipe 66. Next, the pump 313 is operated so as to reduce the inner pressure inside of the container 100. Thus, molten aluminum stored in the second furnace 21 is loaded to the container 100 through the suction pipe 201 and the pipe 56.

According to the present invention, since the molten aluminum stored in the second furnace 21 is loaded to the container 100 through the suction pipe 201 and the pipe 56, the molten aluminum does not contact atmosphere. Thus, no oxide is produced. As a result, the quality of the molten aluminum supplied with the present system becomes very high. In addition, an additional operation for removing oxide from the container 100 is not required. As a result, the operability is improves.

According to the present invention, since the loading of the molten aluminum to the container 100 and the supplying the molten aluminum from the container 100 can be performed substantially with only two pipes 56 and 312, the system structure becomes very simple. In addition, since the chance of which molten aluminum contacts atmosphere becomes very low, production of oxide can be almost suppressed.

Figure 7:
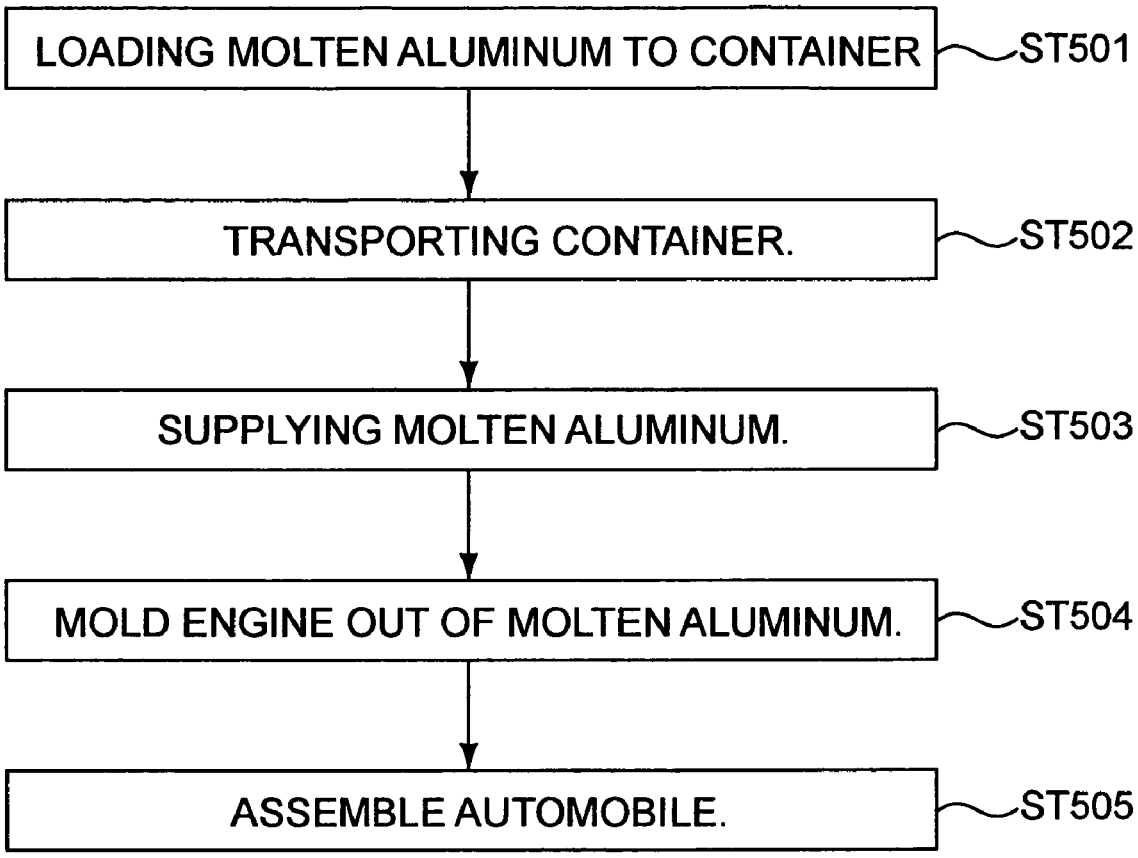
FIG. 7 is a flow chart showing a manufacturing method for automobiles using the system according to the present invention.

FIG. 7 shows a production flow in the case that the foregoing system is applied to an automobile factory.

First, as shown in FIG. 6, the molten aluminum stored in the second furnace 21 is loaded (molten metal is received) into the container 100 through the suction pipe 201 and the pipe 56 (Step 501).

Then, as shown in FIG. 1, the container 100 is carried by the truck 32 through the public road 30 from the second factory 20 to the first factory 10 (Step 502).

Then, in the first factory (use point) 10, the container 100 is delivered by the delivery vehicle 18 to the die-casting machine 11 for producing an automobile engine, and the molten aluminum is supplied from the container 100 to the storing furnace 12 (Step 503).

Then, the die-casting machine 11 molds the automobile engine using the molten aluminum stored in the storing furnace 12 (Step 504).

At last, an automobile is assembled using the automobile engine thus molded and other parts, resulting in a complete automobile (Step 505).

In this embodiment, the automobile engine is made of aluminum containing little or no oxide as described above, thus making it possible to produce an automobile having an engine excellent in performance and durability.

Next, with reference to FIG. 8, another embodiment of the present invention will be described.

Figure 8:
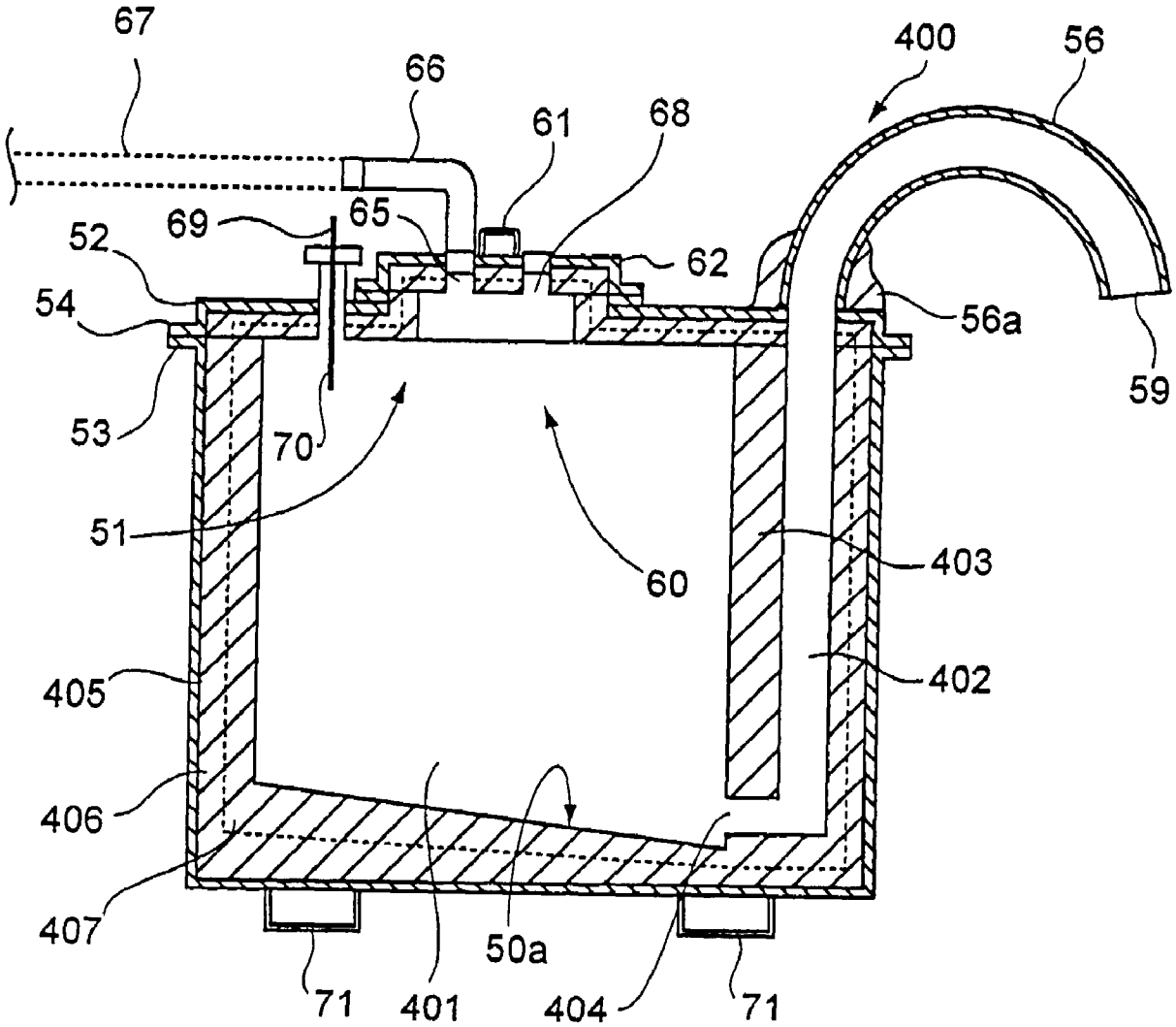
FIG. 8 is a schematic diagram showing the structure of a container according to another embodiment of the present invention.

As shown in FIG. 8, the inside of a container 400 has a storing room 401 and an interface portion 402. The storing room 401 stores molten metal. The interface portion 402 supplies the molten metal to the outside.

A partition wall 403 is disposed between the storing room 401 and the interface portion 402. Formed below the wall 403 is a passage portion 404 as a flow passage of molten metal between the storing room 401 and the interface portion 402.

Like the foregoing embodiment, the container 400 is composed of three layers of a frame 405, a heat insulation member 406, and a refractory member 407. The wall 403 is made of the same material as the refractory member 407. For example, the wall 403 and the refractory member 407 are made of, for example, a dense fire resistant ceramic material.

In the container 400 according to the present invention, the wall 403 made of a member having high heat conductivity is disposed between the storing room 401 and the interface portion 402. Thus, heat from the molten metal stored in the storing room 401 is conducted to the interface portion 402 through the wall 403. As a result, the temperature of the interface portion 402 can be prevented effectively from being decreased. Consequently, the decrease in temperature of the molten metal molten metal is loaded and supplied can be suppressed to the utmost.

Since the structures of the pipes, the lid, and so forth of the present invention are the same as those of the foregoing embodiment, the same elements are denoted by the same reference numerals and their description is omitted.

The present invention is not limited to the foregoing embodiments. Instead, without departing from the spirit of the present invention, various modifications thereof can be implemented.

Figure 9:
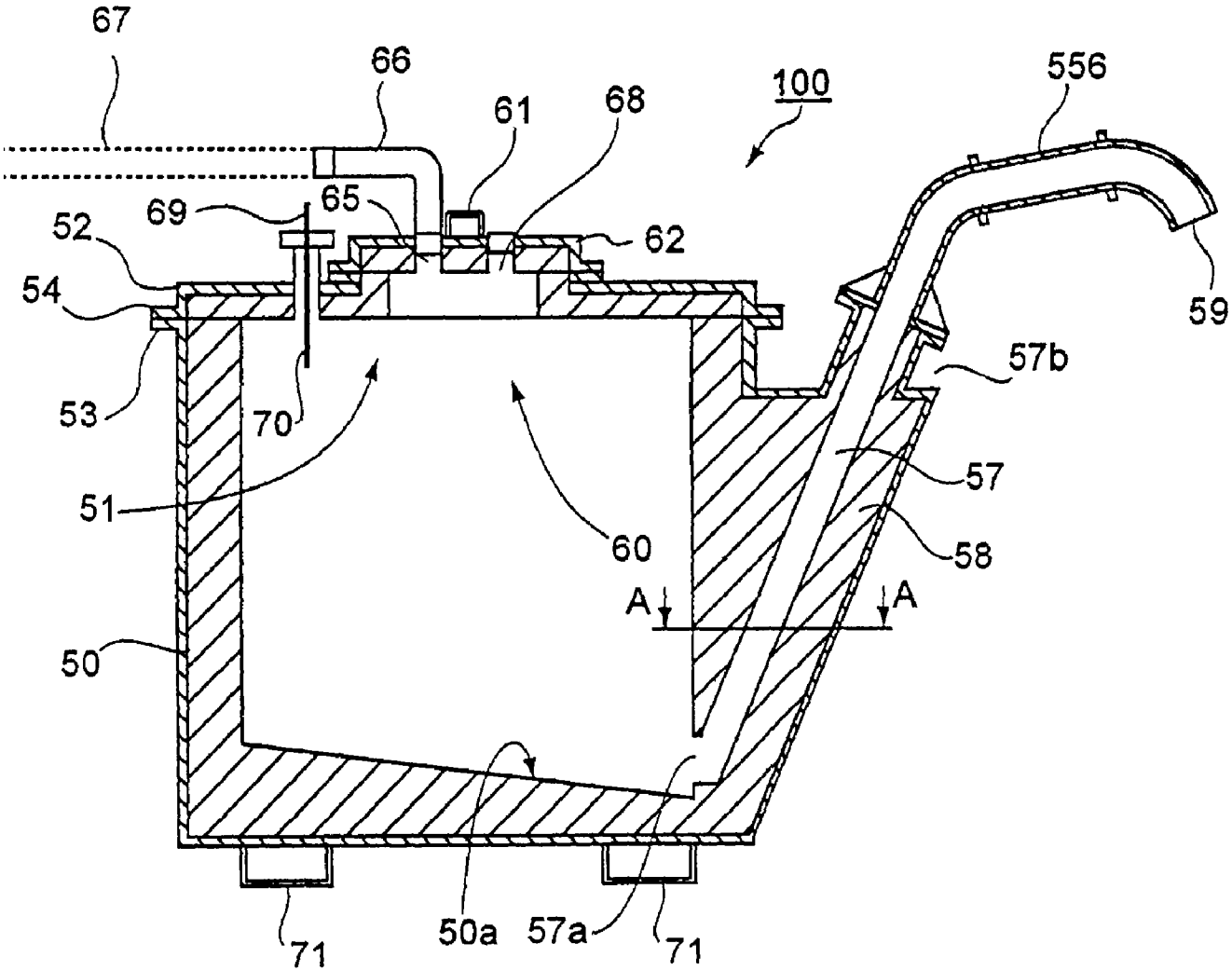
FIG. 9 is a schematic diagram showing the structure of a container according to yet another embodiment of the present invention.

For example, according to the foregoing embodiments, the pipe 56 is formed in an inverse U-letter shape. Alternatively, as shown in FIG. 9, of course, a T-letter shaped pipe 556 may be used.

INDUSTRIAL APPLICABILITY

As was described above, according to the present invention, a container that does not need to replace a part such as stoke can be provided. In addition, the inside of the container can be effectively preheated. Moreover, when the molten metal is loaded and supplied, the decrease in temperature thereof can be suppressed to the utmost.

The invention claimed is:

1. A container for introducing molten metal to an inside of the container, for transporting the molten metal to a use point by a delivery vehicle, and for supplying the molten metal to an outside of the container at a use point by using a pressure difference, the container comprising:

a frame;

a first lining disposed inside the frame, having a passage capable of flowing the molten metal, the first lining having a first thermal conductivity, the passage is formed in the first lining from a position close to a bottom portion of the container to an upper portion of the container;

a second lining disposed between the frame and the first lining, the second lining having a second thermal conductivity lower than the first thermal conductivity; and a cylindrical pipe having a first end and a second end, the first end of the pipe being connected to an upper portion of the passage, the cylindrical pipe being bent so that the second end of the cylindrical pipe is directed downwardly.

2. A container according to claim 1, wherein an inner diameter of the passage is approximately 65 mm to approximately 85 mm.

3. A container according to claim 2, wherein the container has a first opening disposed at an upper portion thereof, wherein the container further comprises a lid detachably disposed to cover the first opening of the container, the lid having a second opening with a diameter smaller than that of the first opening, and wherein the container further comprises a hatch disposed over an upper surface of the lid, the hatch being capable of opened and closed, the hatch covering the second opening, the hatch having a through hole by which the inside of the container communicates with the outside of the container, the through hole being for adjusting an inner pressure of the container.

4. A container for introducing molten metal to an inside of the container, for transporting the molten metal to a use point by a delivery vehicle, and for supplying the molten metal to an outside of the container at theuse point by using a pressure difference, the container comprising:

a frame made of metal, covering outer circumference of the container;

a storing room for storing the molten metal;

an interface portion as a passage for the molten metal between the storing room and the outside of the container, the interface portion having a communicating opening at a lower portion of the interface portion for communicating with a lower portion of the storing room;

a wall partitioning the storing room and the interface portion; and a cylindrical pipe connected to an upper portion of the interface portion, wherein a first lining and a second lining are layered between a region of the storing room and the interface portion and the frame with the first lining being inward, the first lining having a first thermal conductivity, the second lining having a second thermal conductivity lower than the first conductivity, and wherein the wall has a zone filled with the first lining from the communicating opening to the upper portion of the interface portion such that the interface portion is kept warm by the second lining disposed between the interface portion and the frame, and that the thermal conduction from the molten metal stored in the storing room to the interface portion is promoted via the zone, and wherein the cylindrical pipe is bent so that one end of the cylindrical pipe is directed downwardly.

5. A container according to claim 4, wherein an inner diameter of the interface portion as the passage is approximately 65 mm to approximately 85 mm.

6. A container according to claim 5, wherein the container has a first opening disposed at an upper portion thereof, wherein the container further comprises a lid detachably disposed to cover the first opening of the container, the lid having a second opening with a diameter smaller than that of the first opening, and wherein the container further comprises a hatch disposed over an upper surface of the lid, the hatch being capable of opened and closed, the hatch covering the second opening, the hatch having a through hole by which the inside of the container communicates with an outside of the container, the through hole being for adjusting an inner pressure of the container.

7. A container for storing a molten metal and for introducing the molten metal to an inside of the container or for supplying the molten metal to an outside of the container by using a pressure difference, the container being delivered to a use point by a delivery vehicle, the container comprising:

a frame;

a lining inside the frame, having a communicating opening close to a bottom portion of the container, the lining having therein a passage from the communicating opening to a pipe mounting portion disposed at an upper portion of the container, an inner diameter of the passage being approximately 65 mm to approximately 85 mm; and a pipe mounted at the pipe mounting portion for communicating with the passage.

8. A container according to claim 7, wherein the container has a first opening disposed at an upper portion thereof, wherein the container further comprises a lid detachably disposed to cover the first opening of the container, the lid having a second opening with a diameter smaller than that of the first opening, and wherein the container further comprises a hatch disposed over an upper surface of the lid, the hatch being capable of opened and closed, the hatch covering the second opening, the hatch having a through hole by which the inside of the container communicates with the outside of the container, the through hole being for adjusting an inner pressure of the container.

9. A container according to claim 1, wherein the passage capable of flowing the molten metal is cylindrical.

10. A container according to claim 1, wherein the second end of the cylindrical pipe is capable of discharging the molten metal.

11. A container according to claim 4, wherein the end of the cylindrical pipe opposite the end connected to the interface portion is directed downwardly and is capable of discharging the molten metal.

12. A container according to claim 7, wherein the passage is cylindrical.

13. A container according to claim 7, wherein the pipe mounted at the pipe mounting portion is cylindrical.

14. A container according to claim 7, wherein the pipe is capable of discharging the molten metal.

* * * * *